US010137383B2

(12) United States Patent
Maguire et al.

(10) Patent No.: US 10,137,383 B2
(45) Date of Patent: Nov. 27, 2018

(54) LAWN ORNAMENT HAVING FLUID AND/OR WIND DRIVEN INNER AND OUTER FRAMES

(71) Applicant: Plow & Hearth, LLC, Madison, VA (US)

(72) Inventors: Paul D. Maguire, Goochland, VA (US); Lin C. Gregory, North Chesterfield, VA (US); Fei Qiu, Richmond, VA (US)

(73) Assignee: Plow & Hearth, LLC, Madison, VA (US)

( * ) Notice: Subject to any disclaimer, the term of this patent is extended or adjusted under 35 U.S.C. 154(b) by 68 days.

(21) Appl. No.: 15/208,883

(22) Filed: Jul. 13, 2016

(65) Prior Publication Data

US 2018/0015384 A1 Jan. 18, 2018

(51) Int. Cl.

| | |
|---|---|
| ***B05B 3/06*** | (2006.01) |
| ***A63H 33/40*** | (2006.01) |
| ***A63H 29/10*** | (2006.01) |

(52) U.S. Cl.

CPC ..... *A63H 33/40* (2013.01); *A63H 29/10* (2013.01); *B05B 3/06* (2013.01)

(58) Field of Classification Search

CPC ..... A63H 33/40; A63H 29/10; A63H 29/14; A63H 29/16; B05B 3/06; B05B 1/207; B05B 15/062; B05B 3/026; B05B 3/027; B05B 3/0495; B05B 3/066; B05B 17/08

USPC ..... 239/12, 16, 17, 22, 23, 280

See application file for complete search history.

(56) References Cited

U.S. PATENT DOCUMENTS

| | | | | |
|---|---|---|---|---|
| 4,591,094 | A * | 5/1986 | Morris | B05B 17/08 239/17 |
| 6,109,546 | A | 8/2000 | Ormiston | |
| 6,439,478 | B1 | 8/2002 | King et al. | |
| 6,533,190 | B1 * | 3/2003 | Wang | B05B 1/205 239/17 |
| 6,604,691 | B1 | 8/2003 | Thomas et al. | |

* cited by examiner

*Primary Examiner* — Darren W Gorman
*Assistant Examiner* — Juan C Barrera
(74) *Attorney, Agent, or Firm* — Jordan IP Law, LLC; Todd A. Vaughn

(57) ABSTRACT

A lawn or garden ornament having an inner frame and an outer frame. The outer frame is to receive a fluid such that at least one first orifice arranged therein is to discharge a portion of the fluid in a first direction outwardly therefrom to cause rotation of the outer frame, and at least one second orifice arranged therein is to discharge a portion of the fluid in a second direction inwardly therefrom to contact a surface of inner frame and thereby cause rotation of the inner frame.

19 Claims, 10 Drawing Sheets

LAWN ORNAMENT HAVING FLUID AND/OR WIND DRIVEN INNER AND OUTER FRAMES

TECHNICAL FIELD

Embodiments relate to a lawn and/or garden ornament having an inner frame and an outer frame concentrically, non-concentrically, or orbitally arranged with respect to the inner frame. The outer frame is to receive a fluid such that at least one first orifice arranged therein is to discharge a portion of the fluid in a first direction outwardly therefrom to cause rotation of the outer frame, and at least one second orifice arranged therein is to discharge a portion of the fluid in a second direction inwardly therefrom to contact a surface of inner frame and thereby cause rotation of the inner frame.

BACKGROUND

Lawn and/or garden ornaments are generally placed in an open lawn and/or garden area of a property.

DRAWINGS

DESCRIPTION

Figure 1:
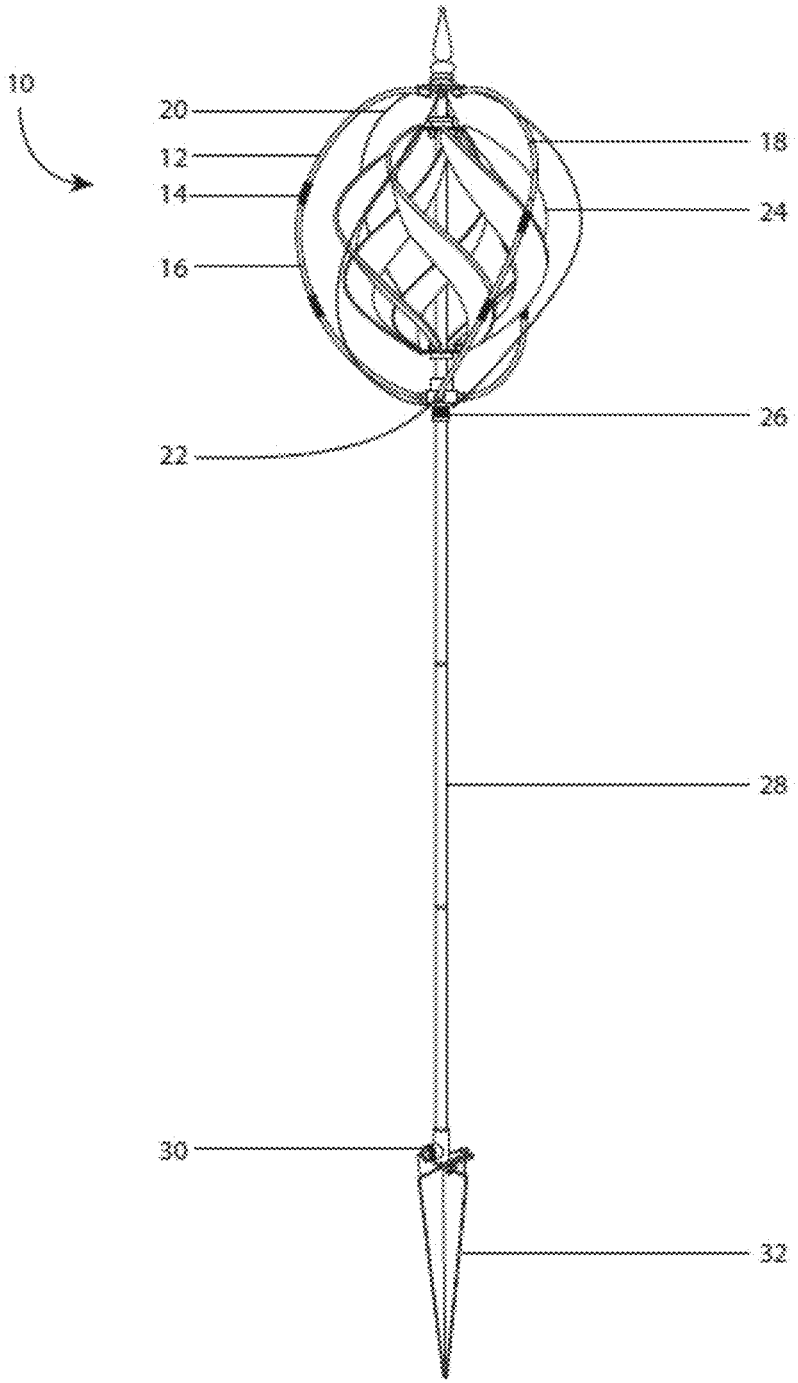
FIG. 1 illustrates a decorative lawn ornament, in accordance with embodiments.
Figure 2:
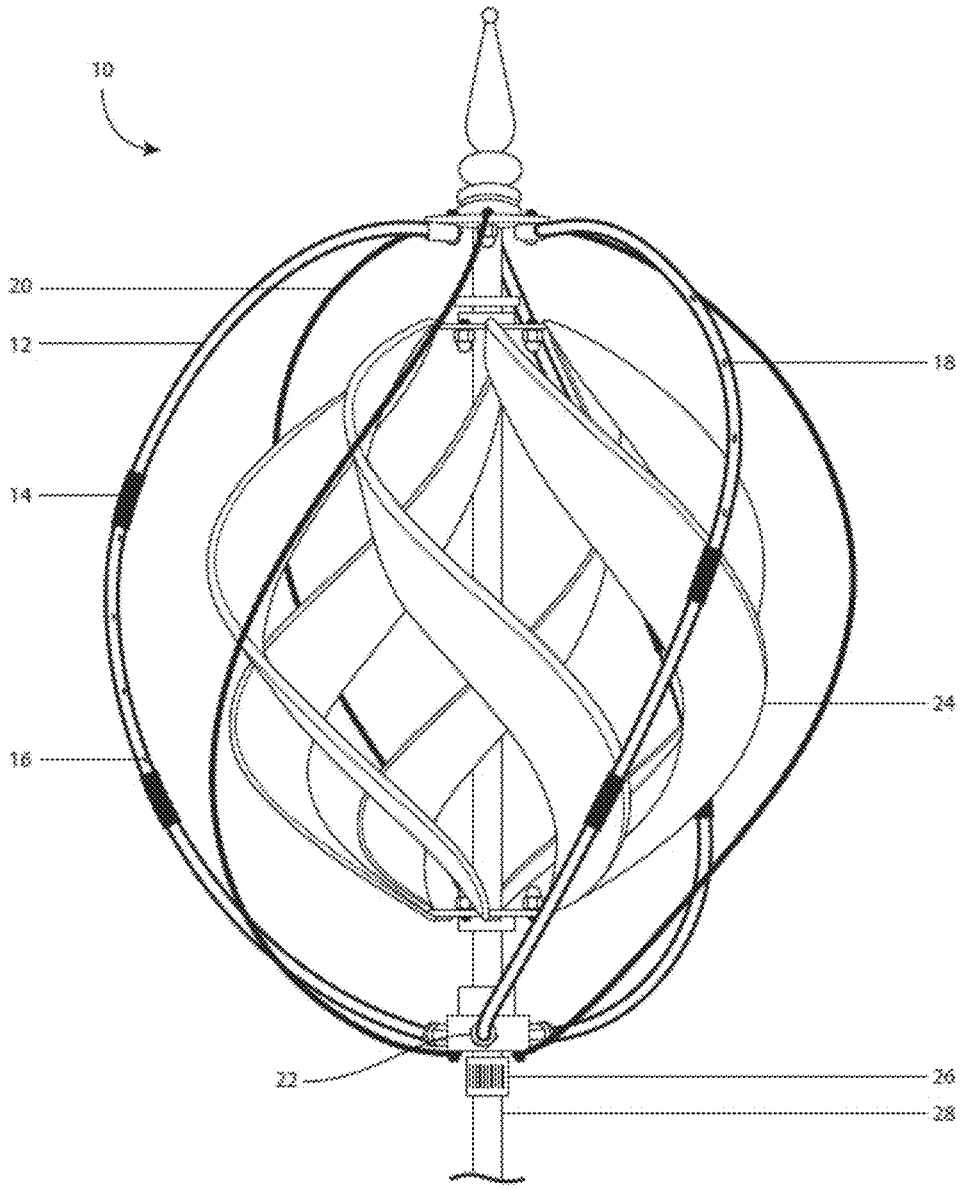
FIG. 2 illustrates a side partial view of the inner frame and outer frame of the decorative lawn ornament of FIG. 1.
Figure 3:
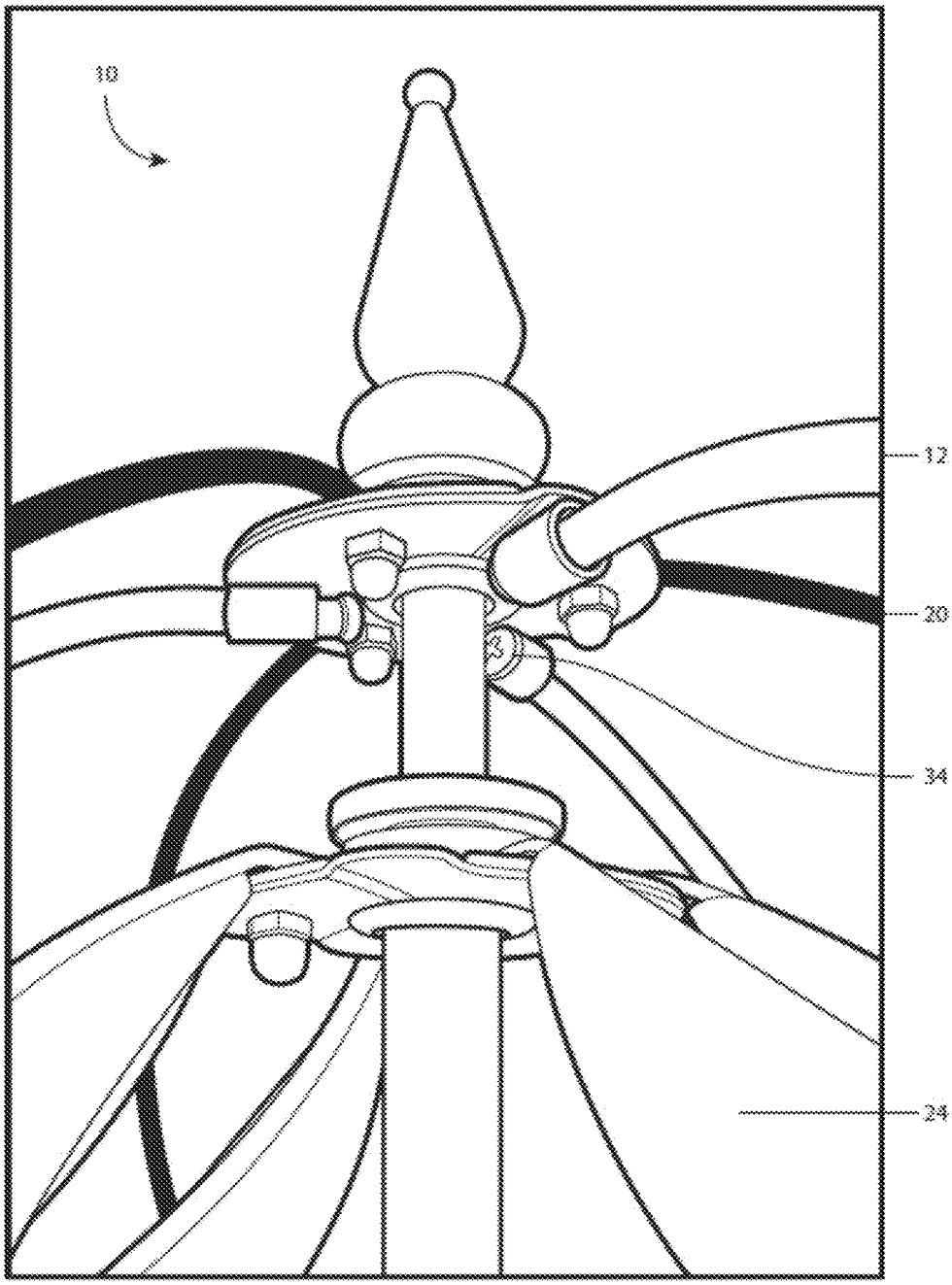
FIG. 3 illustrates a partial perspective view of the inner frame and outer frame of the decorative lawn element of FIG. 1.
Figure 4:
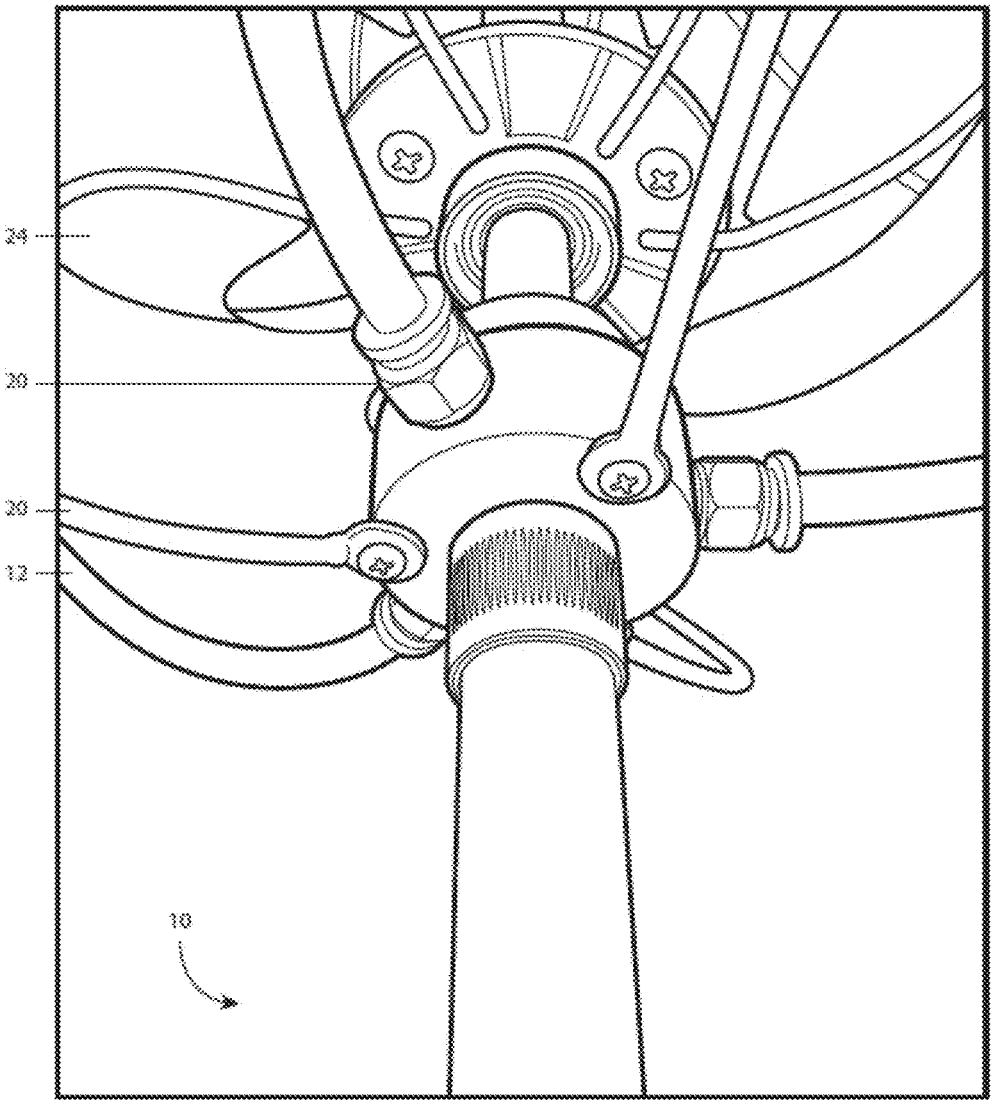
FIG. 4 illustrates a partial bottom view of the inner frame and outer frame of the decorative lawn element of FIG. 1.

As illustrated in FIG. 1, in accordance with embodiments is a decorative lawn ornament 10 for placement in an open area of a lawn, garden or the like for supplying a fluid such as water to an underlying support surface. The lawn ornament 10 includes an outer frame 12, 20 comprising fluid conduits 12 and support rods 20, an inner frame 24, and a support member 28 which supports the outer frame 12, 20 and the inner frame 24. In accordance with embodiments, at least one of the frames 12, 20, 24 may have an ornamental or decorative appearance. Alternatively, the frames 12, 20, 24 may be non-ornamental or non-decorative in appearance.

Figure 5:
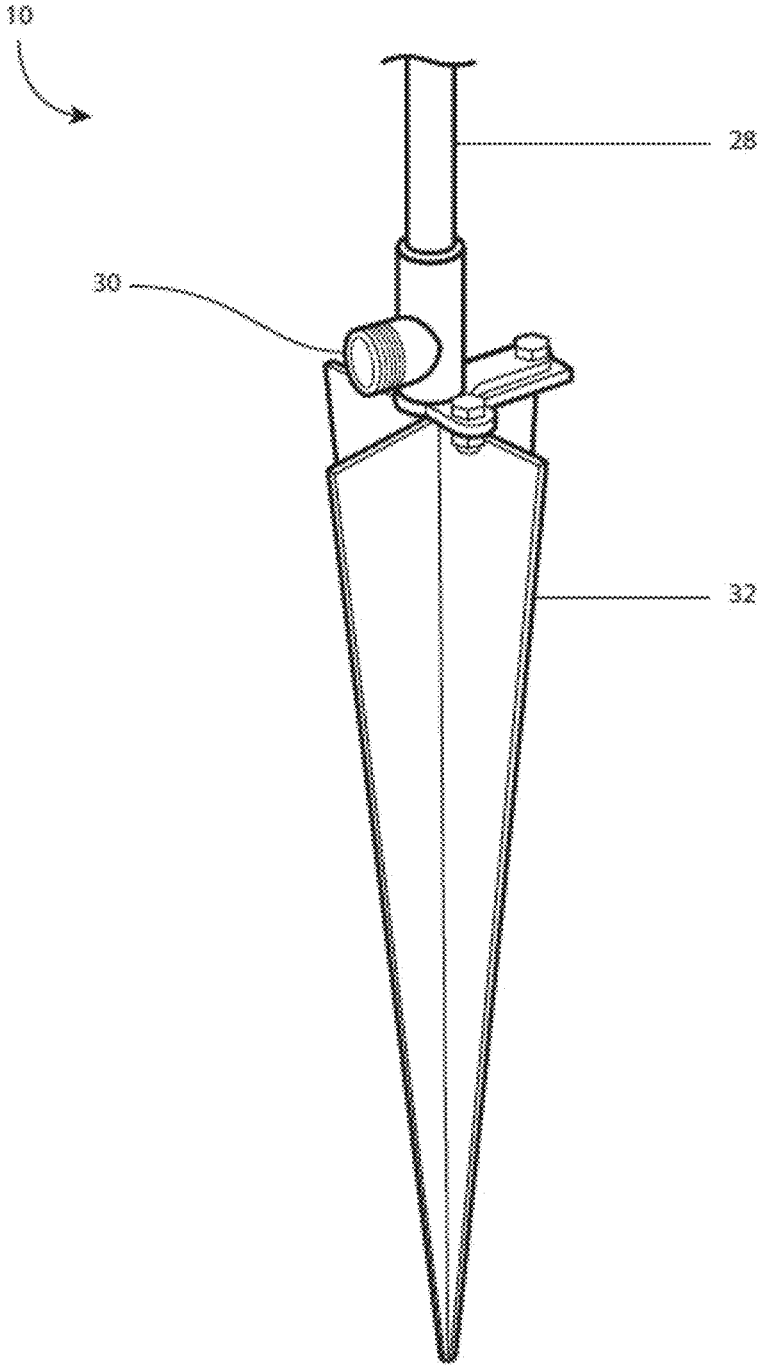
FIG. 5 illustrates a view of the support member of the decorative lawn element of FIG. 1.
Figure 6:
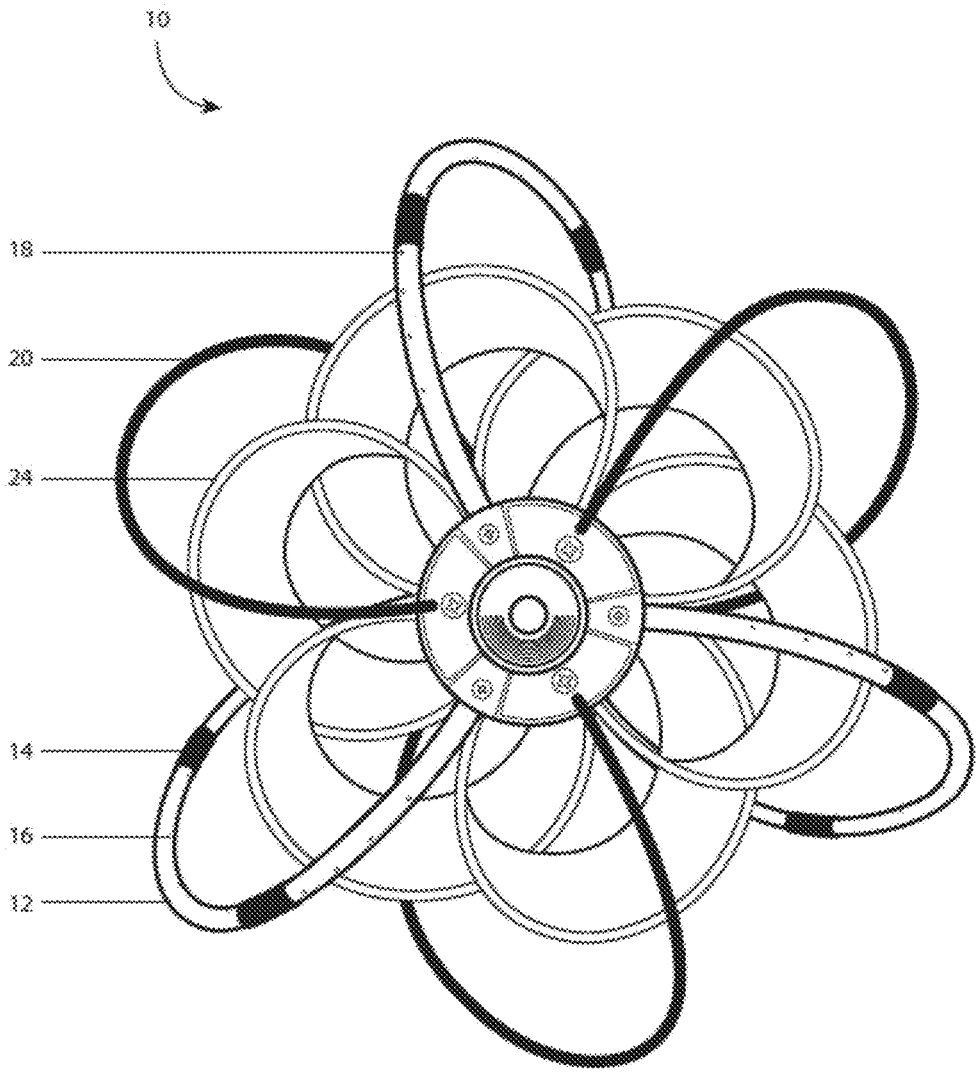
FIG. 6 illustrates a top view of the inner frame and outer frame of the decorative lawn element of FIG. 1.
Figure 7:
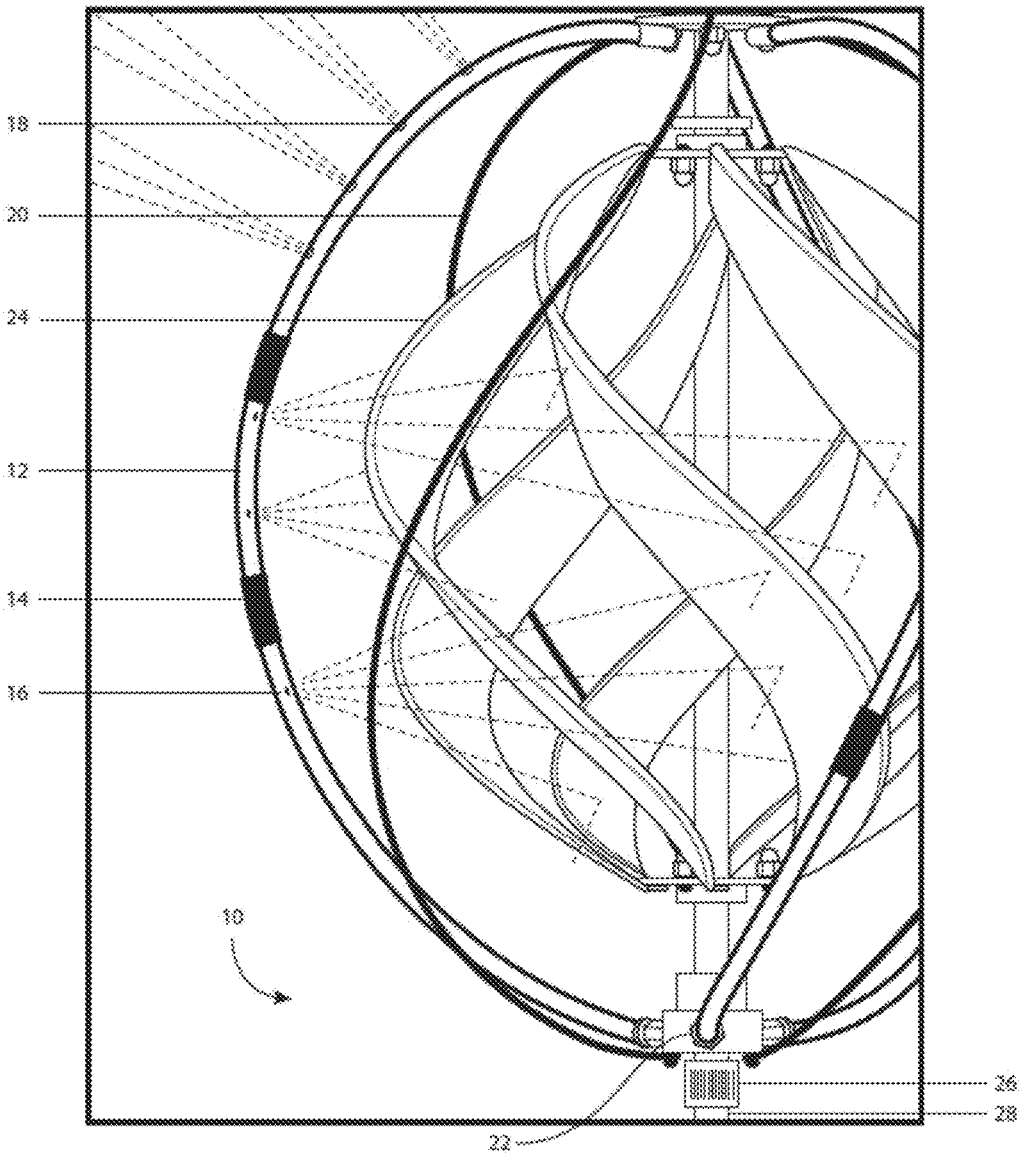
FIG. 7 illustrates a partial view of discharge of fluid from the inner frame and outer frame of the decorative lawn element of FIG. 1.
Figure 8:
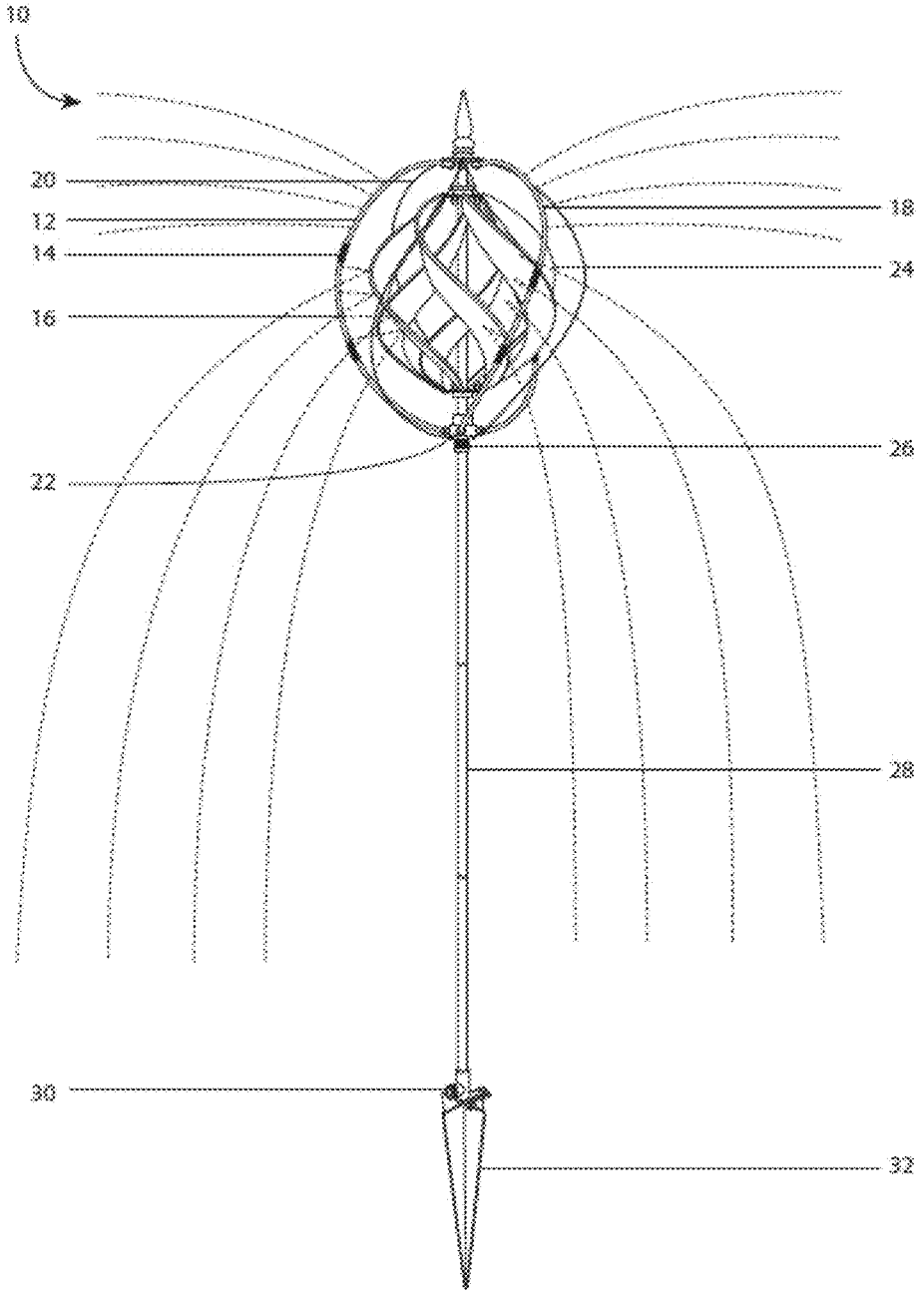
FIG. 8 illustrates a side view of the fluid spray pattern of the inner frame and outer frame of the decorative lawn element of FIG. 1.

The support member 28, at a proximal end thereof, is to support the outer frame 12, 20 and the inner frame 24. As illustrated in FIG. 5, the support member 28, at a distal end thereof, has a base such as, for example, a ground spike 32 that is insertable into a support surface which is to support the lawn ornament 10. The support surface may be a natural one that includes the ground of the lawn, garden or the like, or an artificial one that is to be placed on and/or over the lawn, garden or the like. The support member 28 includes a fluid connector 30 to permit fluidic communication of the lawn ornament 10 with a fluid source, such as a water supply system.

As illustrated in FIGS. 2-4 and 6, the inner frame 24 is to be supported on the support member 28 for rotational movement about a longitudinal axis defined by the support member 28. The inner frame 24 may include at least one inner frame member or blade mechanically connected at upper and/or lower connected regions thereof to a corresponding bearing or collar that is to be arranged on the support member 28. While the inner frame 24 is illustrated having a twisting shape, embodiments are not limited to such a configuration. The inner frame 24 may have any shape that permits practice of embodiments.

In accordance with embodiments, in operation of the lawn ornament 10, the inner frame 24 may be supported on the support member 28 so as to be driven for rotation by wind power. Meaning, rotation of the inner frame 24 may be initiated when a flow of air strikes a surface of the blades.

The outer frame 12, 20 is to be supported on the support member 28, and is concentrically, or orbitally arranged with respect to the inner frame 24. Alternatively, the outer frame 12, 20 may be supported non-concentrically, or non-orbitally with respect to the inner frame 24. The outer frame 12 may comprise at least one outer frame member 12 formed as fluid sprinkler conduits to receive and permit flow of a fluid, and at least one outer support rod 20 that have a structural support function. The outer frame 12, 20 is sealingly connected to the support member 28, at an upper region thereof, via upper connection points 34, and/or at a lower region thereof, via fluid connections 22, to a connection collar. A stem that supports the outer frame 12, 20 and the inner frame 24 is connected at lower connection collar 26.

In accordance with embodiments, the outer frame 12, 20 may be connected to the support member 28 for rotational movement about a longitudinal axis defined by the support member 28. While the outer frame members 12 and the outer frame support rods 20 are illustrated having a generally circular configuration, embodiments are not limited thereto. The outer frame members 12 and the outer frame support rods 20 may have any shape that permits practice of embodiments.

As illustrated in FIGS. 6-9, the outer frame fluid conduits 12 are in fluidic communication with the support member 28 to receive fluid from the fluid source that flows through the support member 28. At least one outer frame fluid conduit 12 includes at least one first aperture, nozzle, hole, or orifice 18. Multiple first orifices 18 are to be spaced apart from each other. The at least one first orifice 18 is configured to discharge or otherwise direct a portion of the fluid in a first direction outwardly from the outer frame fluid conduit 12 to impart, induce, or cause rotation of the outer frame fluid conduit 12 relative to the inner frame 24 and the support member 28.

At least one outer frame fluid conduit 12 includes at least one second aperture, nozzle, hole, or orifice 16. Multiple second orifices 16 are to be spaced apart from each other. The at least one second orifice 16 is configured to discharge or otherwise direct a portion of the fluid in a second direction inwardly from the outer frame fluid conduit 12. The inwardly directed fluid is to contact or otherwise strike a surface of the inner frame 24, and thereby impart, induce, or otherwise cause rotation of the inner frame 24 relative to the outer frame 12, 20 and the support member 28. In that way, the inner frame may be driven not only by force of wind, but also by force of the contacting fluid discharged from the at least one orifice 16.

Figure 9:
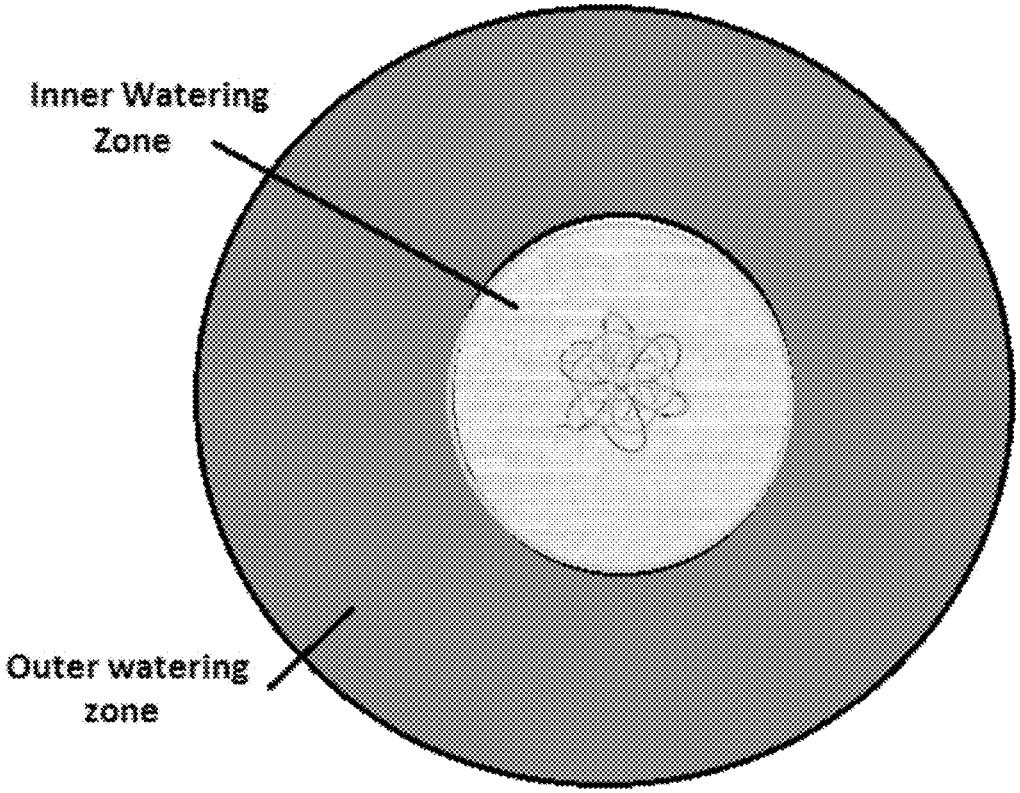
FIG. 9 illustrates the fluid spray zones from the decorative lawn element of FIG. 1.

As illustrated in FIG. 9, the at least one first aperture, nozzle, hole, or orifice 18, due to being arranged outwardly on the surface of the outer frame 12, 20 is to direct the fluid to an area on a support surface that creates a first fluid spray zone 40. The at least one second aperture, nozzle, hole, or orifice 16, due to being arranged inwardly on the surface of the outer frame 12, is to direct the fluid, upon contact with the inner frame 24, to an area on a support surface that creates a second fluid spray zone 41 that is arranged concentric to the first fluid spray zone 40. Alternatively, the fluid spray zones 40, 41 may be non-concentrically arranged with respect to each other.

In accordance with embodiments, in operation of the lawn ornament 10, the outer frame 12, 20 may be supported on the support member 28 so as to be driven for rotation by discharge of the fluid therefrom. Alternatively, or additionally, the outer frame 12, 20 may be supported on the support member 28 so as to be driven for rotation due to a flow of air striking a surface thereof.

In accordance with embodiments, while the first fluid spray zone 40 is illustrated as being greater in area than the second fluid spray zone 41, embodiments are not limited thereto. The first fluid spray zone 40 and the second fluid spray zone 41 may be unequal in area such that the first fluid spray zone 40 is lesser in area than the second fluid spray zone 40.

In accordance with embodiments, while the first fluid spray zone 40 and the second fluid spray zone 41 are circular, embodiments are not limited thereto. The first fluid spray zone 40 and the second fluid spray zone 41 may have a non-circular geometric shape that permits practice of embodiments.

At least one outer frame fluid conduit 12 may include at least one cover sleeve 14 arranged for selective movement along the length of a corresponding outer frame fluid conduit 12. Such selective movement is to block discharge of the fluid from one or more orifices 16, 18, thereby controlling discharge of the fluid from the outer frame fluid conduit 12. This arrangement is advantageous in permitting a user to selectively modify or customize the spray radius, volume, and/or area that create the fluid spray zones 40, 41. For instance, a user may prefer that a certain area receive more or less fluid. The at least one cover sleeve 14 may be removeably attached to a corresponding outer frame fluid conduit 12, or alternatively, permanently attached.

Figure 10:
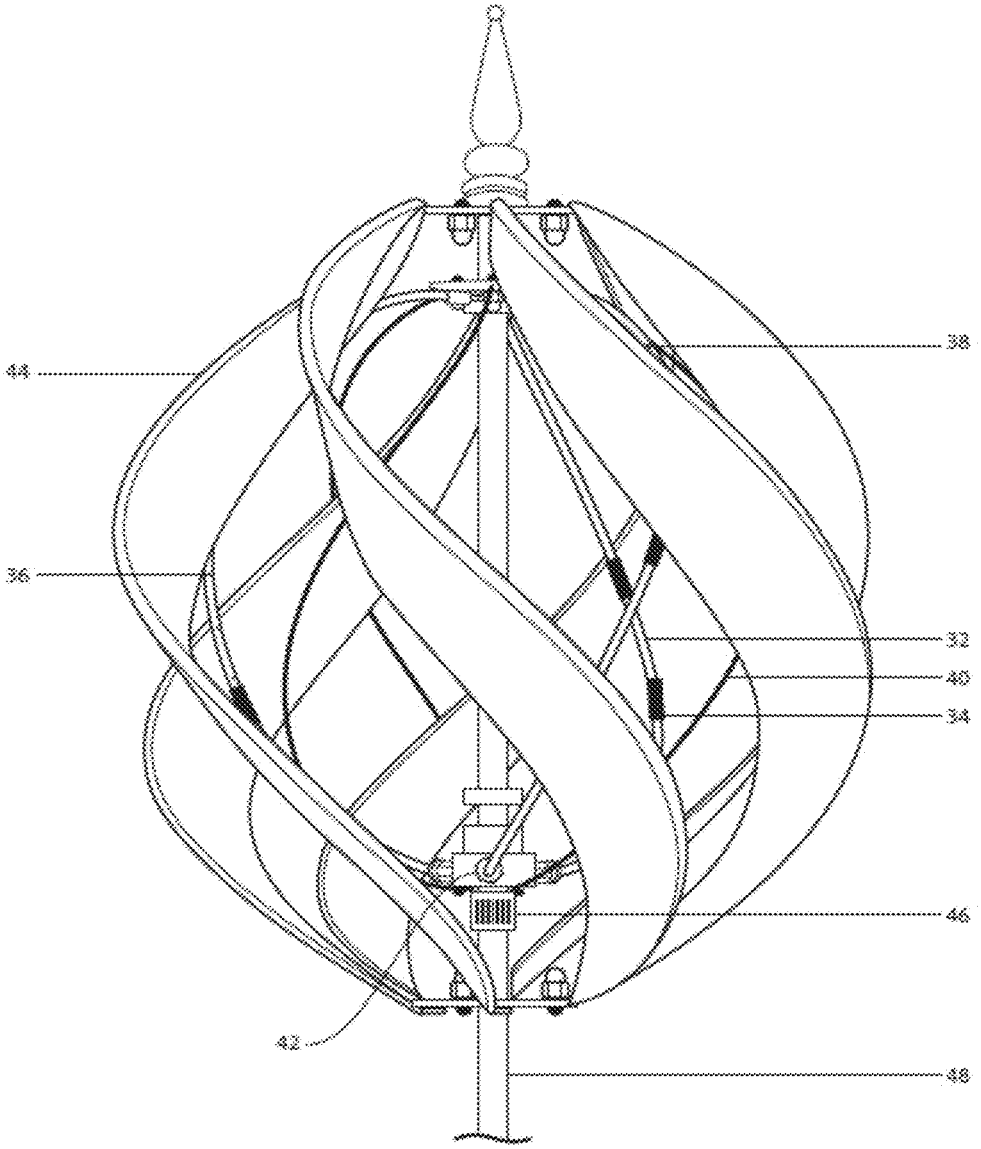
FIG. 10 illustrates a side partial view of an inner frame and an outer frame of a decorative lawn ornament, in accordance with embodiments.

As illustrated in FIG. 10, in accordance with embodiments, alternatively, the decorative lawn ornament 10 may be configured such that the outer frame 44 is to be driven for rotation by air, and the inner frame 32, 40 is to be driven for rotation by discharge of the fluid therefrom. In this embodiment, the inner frame 32, 40 is to cause further rotation of the outer frame 44 due to outwardly directed fluid contacting or otherwise striking a surface of the outer frame 44, and thereby imparting, inducing, or otherwise causing rotation of the outer frame 44 relative to the inner frame 32, 40 and the support member 48.

The inner frame 32, 40 is to be supported on the support member 28, and is concentrically, or orbitally arranged with respect to the outer frame 44. Alternatively, the inner frame 32, 40 may be supported non-concentrically, or non-orbitally with respect to the outer frame 44. The inner frame may comprise at least one outer frame member 32 formed as fluid sprinkler conduits to receive and permit flow of a fluid, and at least one outer support rod 40 that has a structural support function. The inner frame 32, 40 is sealingly connected to the support member 48, at an upper region thereof, via upper connection points, and/or at a lower region thereof, via fluid connections 42, to a connection collar. A stem that supports the inner frame 32, 40 and the outer frame 44 is connected at lower connection collar 46.

In accordance with embodiments, the inner frame 32, 40 may be connected to the support member 48 for rotational movement about a longitudinal axis defined by the support member 48. While the inner frame members 32 and the inner frame support rods 40 are illustrated having a generally circular configuration, embodiments are not limited thereto. The inner frame members 32 and the inner frame support rods 40 may have any shape that permits practice of embodiments.

As illustrated in FIG. 10, the inner frame fluid conduits 32 are in fluidic communication with the support member 28 to receive fluid from the fluid source that flows through the support member 28. At least one inner frame fluid conduit 32 includes at least one first aperture, nozzle, hole, or orifice 38. Multiple first orifices 38 are to be spaced apart from each other. The at least one first orifice 38 is configured to discharge or otherwise direct a portion of the fluid in a first direction outwardly from the inner frame fluid conduit 32. The outwardly directed fluid is to contact or otherwise strike a surface of the outer frame 44, and thereby impart, induce, or otherwise cause rotation of the outer frame 44 relative to the inner frame 32, 40 and the support member 48. In that way, the outer frame may be driven not only by force of wind, but also by force of the contacting fluid discharged from the at least one orifice 38.

The at least one inner frame fluid conduit 32 may also include at least one second aperture, nozzle, hole, or orifice 36. Multiple second orifices 36 are to be spaced apart from each other. The at least one second orifice 36 is configured to discharge or otherwise direct a portion of the fluid in a second direction from the inner frame fluid conduit 32 to direct the fluid to an area on a support surface that creates a spray zone.

ADDITIONAL NOTES AND EXAMPLES

Example One may include a lawn ornament comprising an inner frame; and an outer frame that is orbitally-arranged with respect to the inner frame, the outer frame being in fluidic communication with a fluid source to receive the fluid, wherein the outer frame has: at least one first orifice to discharge a portion of the fluid in a first direction outwardly therefrom to cause rotation of the outer frame; and at least one second orifice to discharge a portion of the fluid in a second direction inwardly therefrom to contact a surface of and thereby cause rotation of the inner frame.

Example Two may include the lawn ornament of Example One, wherein the at least one first orifice is to direct the fluid to an area on a support surface that creates a first fluid spray zone.

Example Three may include the lawn ornament of Example Two, wherein the at least one second orifice is to direct the fluid to an area on a support surface that creates a second fluid spray zone.

Example Four may include the lawn ornament of Example Three, wherein the first fluid spray zone is greater in diameter than the second fluid spray zone.

Example Five may include the lawn ornament of Example Three, wherein the inner frame comprises at least one inner frame member.

Example Six may include the lawn ornament of Example One, wherein the outer frame comprises at least one fluid conduit to receive the fluid, and which includes the at least one first orifice to discharge fluid in a first direction and the at least one second orifice to discharge fluid in a second direction that is different than the first direction.

Example Seven may include the lawn ornament of Example One, at least one outer frame member having at least one fluid conduit to receive the fluid, and which includes the at least one first orifice to discharge fluid in the first direction; and at least a second outer frame member having at least one fluid conduit to receive the fluid, and which includes the at least second orifice to discharge fluid in the second direction.

Example Eight may include a lawn ornament comprising a support member; an inner frame arranged on the support member; and an outer frame orbitally-arranged on the support member with respect to the inner frame, the outer frame to receive a fluid from a fluid source, wherein the outer frame has: at least one first orifice at an outwardly facing surface to discharge a portion of the fluid in a first direction outwardly therefrom to cause rotation of the outer frame; and at least one second orifice at an inwardly facing surface to discharge a portion of the fluid in a second direction inwardly therefrom to contact a surface of and thereby cause rotation of the inner frame.

Example Nine may include the lawn ornament of Example Eight, wherein the support member is to receive fluid from a fluid source.

Example Ten may include the lawn ornament of Example Nine, wherein the outer frame comprises at least one fluid conduit to receive the fluid from the support member.

Example Eleven may include the lawn ornament of Example Eight, further comprising at least one cover sleeve arranged for selective movement on a corresponding outer frame member to control discharge of the fluid from the at least one first orifice and the at least one second orifice.

Example Twelve may include the lawn ornament of Example Eight, wherein the outer frame comprises at least one support rod.

Example Thirteen may include the lawn ornament of Example Eight, wherein the inner frame is wind-driven.

Example Fourteen may include the lawn ornament of Example Eight, wherein the inner frame comprises at least one inner frame member.

Example Fifteen may include the lawn ornament of Example Eight, wherein the first orifices are to direct the fluid to an area on a support surface that creates a first fluid spray zone.

Example Sixteen may include the lawn ornament of Example Fifteen, wherein the second orifices are to direct the fluid to an area on a support surface that creates a second fluid spray zone.

Example Seventeen may include the lawn ornament of Example Sixteen, wherein the first fluid spray zone is greater in diameter than the second fluid spray zone.

Example Eighteen may include a lawn ornament comprising an inner frame driven by wind for rotation; an outer frame having at least one outer frame member to receive a fluid from a fluid source, wherein the at least one outer frame member has: at least one first orifice at an outwardly facing surface to discharge a portion of the fluid in a first direction outwardly therefrom to cause rotation of the outer frame; and at least one second orifice at an inwardly facing surface to discharge a portion of the fluid in a second direction inwardly therefrom to contact a surface of and thereby cause rotation of the inner frame.

Example Nineteen may include the lawn ornament of Example Eighteen, further comprising at least one cover sleeve arranged for selective movement on a corresponding outer frame member to control discharge of the fluid from at least one of the at least one first orifice and the at least one second orifice.

Example Twenty may include a lawn ornament comprising an outer frame driven by wind for rotation; an inner frame having at least one inner frame member to receive a fluid from a fluid source, wherein the at least one inner frame member has: at least one first orifice to discharge a portion of the fluid in a first direction inwardly therefrom to cause rotation of the inner frame; and at least one second orifice to discharge a portion of the fluid in a second direction outwardly therefrom to contact a surface of and thereby cause rotation of the outer frame.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A lawn ornament, comprising:

an inner frame; and an outer frame that is orbitally-arranged with respect to the inner frame, the outer frame being in fluidic communication with a fluid source to receive the fluid, wherein the outer frame has:

at least one first orifice to discharge a portion of the fluid in a first direction outwardly therefrom to cause rotation of the outer frame about a longitudinal axis; and at least one second orifice to discharge a portion of the fluid in a second direction inwardly therefrom and external to the outer frame to contact an outer surface of and thereby cause rotation of the inner frame about the same longitudinal axis as the outer frame.

2. The lawn ornament of claim 1, wherein the at least one first orifice is to direct the fluid to an area on a support surface that creates a first fluid spray zone.

3. The lawn ornament of claim 2, wherein the at least one second orifice is to direct the fluid to an area on a support surface that creates a second fluid spray zone.

4. The lawn ornament of claim 3, wherein the first fluid spray zone is greater in diameter than the second fluid spray zone.

5. The lawn ornament of claim 1, wherein the inner frame comprises at least one inner frame member.

6. The lawn ornament of claim 1, wherein the outer frame comprises at least one fluid conduit to receive the fluid, and which includes the at least one first orifice to discharge fluid in a first direction and the at least one second orifice to discharge fluid in a second direction that is different than the first direction.

7. The lawn ornament of claim 1, wherein the outer frame comprises:

at least one outer frame member having at least one fluid conduit to receive the fluid, and which includes the at least one first orifice to discharge fluid in the first direction; and at least a second outer frame member having at least one fluid conduit to receive the fluid, and which includes the at least one second orifice to discharge fluid in the second direction.

8. A lawn ornament, comprising:

a support member;

an inner frame arranged on the support member; and an outer frame orbitally-arranged on the support member with respect to the inner frame, the outer frame to receive a fluid from a fluid source, wherein the outer frame has:

at least one first orifice to discharge a portion of the fluid in a first direction outwardly therefrom to cause rotation of the outer frame about a longitudinal axis; and at least one second orifice to discharge a portion of the fluid in a second direction inwardly therefrom and external to the outer frame to contact an outer surface of and thereby cause rotation of the inner frame about the same longitudinal axis as the outer frame.

9. The lawn ornament of claim 8, wherein the support member is to receive fluid from a fluid source.

10. The lawn ornament of claim 9, wherein the outer frame comprises at least one fluid conduit to receive the fluid from the support member.

11. The lawn ornament of claim 8, further comprising at least one cover sleeve arranged for selective movement on a corresponding outer frame member to control discharge of the fluid from the at least one first orifice.

12. The lawn ornament of claim 8, wherein the outer frame comprises at least one support rod.

13. The lawn ornament of claim 8, wherein the inner frame is wind-driven.

14. The lawn ornament of claim 8, wherein the inner frame comprises at least one inner frame member.

15. The lawn ornament of claim 8, wherein the first orifices are to direct the fluid to an area on a support surface that creates a first fluid spray zone.

16. The lawn ornament of claim 15, wherein the second orifices are to direct the fluid to an area on a support surface that creates a second fluid spray zone.

17. The lawn ornament of claim 16, wherein the first fluid spray zone is greater in diameter than the second fluid spray zone.

18. A lawn ornament, comprising:

an inner frame driven by wind for rotation;

an outer frame having at least one outer frame member to receive a fluid from a fluid source, wherein the at least one outer frame member has:

at least one first orifice at an outwardly facing surface to discharge a portion of the fluid in a first direction outwardly therefrom to cause rotation of the outer frame about a longitudinal axis; and at least one second orifice at an inwardly facing surface to discharge a portion of the fluid in a second direction inwardly therefrom and external to the outer frame to contact an outer surface of and thereby cause rotation of the inner frame about the same longitudinal axis as the outer frame.

19. The lawn ornament of claim 18, further comprising at least one cover sleeve arranged for selective movement on a corresponding outer frame member to control discharge of the fluid from at least one of the at least one first orifice and the at least one second orifice.

* * * * *